United States Patent [19]

Fisher et al.

[11] Patent Number: 4,485,004

[45] Date of Patent: Nov. 27, 1984

[54] CATALYTIC HYDROCRACKING IN THE PRESENCE OF HYDROGEN DONOR

[75] Inventors: Ian P. Fisher, Oakville; Nicolas G. Samman, Mississauga, both of Canada

[73] Assignee: Gulf Canada Limited, Toronto, Canada

[21] Appl. No.: 415,194

[22] Filed: Sep. 7, 1982

[51] Int. Cl.[3] ..... C10G 47/34

[52] U.S. Cl. ..... 208/112; 208/56; 208/108; 208/145; 208/251 H; 208/107

[58] Field of Search ..... 208/112, 56, 107, 108, 208/251 H, 145

[56] References Cited

U.S. PATENT DOCUMENTS

| | | | |
|---|---|---|---|
| 2,796,386 | 6/1957 | Cahn | 208/56 |
| 3,147,206 | 9/1964 | Tulleners | 208/56 |
| 3,168,459 | 2/1965 | Anderson et al. | 208/56 |
| 4,163,707 | 8/1979 | Goudriaan et al. | 208/56 |
| 4,216,078 | 8/1980 | Plumlee et al. | 208/56 |
| 4,298,452 | 11/1981 | Dorawala et al. | 208/8 LE |

OTHER PUBLICATIONS

Aarts, J. J. B. et al., "Catalytic Desulphurization of Athabasca Bitumen Using Hydrogen Donors", *Fuel*, vol. 57, pp. 473–478 (Aug. 1978).

Sakabe, T., et al., "Crack Resid with Spent HDS Catalyst," *Hydrocarbon Processing*, Dec. 1979, pp. 103–107.

Varga, J. et al. "Now You Can Hydrocrack Those Asphaltic Crudes," *Petroleum Refiner*, vol. 36, No. 9, pp. 198–200 (Sep. 1957).

*Primary Examiner*—Curtis R. Davis
*Assistant Examiner*—Anthony McFarlane
*Attorney, Agent, or Firm*—R. H. Saunders

[57] ABSTRACT

A process is disclosed in which a heavy hydrocarbon oil is converted to lighter products by hydrocracking in the presence of a hydrogen donor material boiling from 200° C. to 300° C. and a particulate hydrogenation catalyst comprising one of cobalt, molybdenum, nickel, tungsten and mixtures thereof.

27 Claims, No Drawings

CATALYTIC HYDROCRACKING IN THE PRESENCE OF HYDROGEN DONOR

This invention relates to a process for the upgrading of heavy hydrocarbonaceous oils by hydrocracking in the presence of a hydrogen donor diluent. More particularly, it relates to a process for upgrading heavy hydrocarbonaceous oils by carrying out the hydrocracking in the presence of a hydrogenation catalyst and molecular hydrogen.

With the continuing decline in the availability of light crude oils, it is increasingly necessary to turn to the heavier crudes of API gravity 25° and less as sources of liquid fuels, particularly transportation fuels. The use of hydrogen donors to upgrade these heavy oils into commercially useful light products is well-known. Catalyzed donor diluent cracking reactions were described by Varga et al. in Petroleum Refiner, September 1957, p. 198, in which pulverized brown coal semi-coke was employed as a catalyst with tetralin or distillates and hydrogen to hydrocrack an undistilled heavy crude oil. In a test using Athabasca oil and bitumen, on the other hand, Aarts, Ternan and Parsons, in Fuel (1978) p. 473, concluded that the use of hydrogen donor diluents was not advantageous for catalytic hydrocracking. A process for upgrading residuum using spent catalyst with molecular hydrogen was described by Sakabe et al. in Hydrocarbon Processing, December 1979, p. 103. That process utilized no hydrogen donor, and the process was not shown to demetallize or upgrade tar sands vacuum residuum.

These and other difficulties in upgrading Athabasca and other oil sands bitumen have been overcome by the present invention which consists in a process for upgrading heavy, viscous hydrocarbonaceous oil comprising contacting said oil with a liquid hydrogen donor material, a hydrogen-rich gas and a particulate hydrogenation catalyst in a hydrocracking zone at hydrocracking conditions to produce a hydrocracked material, said catalyst comprising one of cobalt, molybdenum, nickel, tungsten and mixtures thereof.

The invention further consists in a process for upgrading heavy, viscous hydrocarbonaceous oil comprising the steps of:

contacting said oil with a liquid hydrogen donor material, molecular hydrogen and a particulate hydrogenation catalyst at hydrocracking conditions in a hydrocracking zone to produce a hydrocracked material, said catalyst comprising one of cobalt, molybdenum, nickel, tungsten, and mixtures thereof;

separating said hydrocracked material into at least one fraction boiling below substantially 200° C., a donor fraction boiling from substantially 200° C. to substantially 300° C., and at least one fraction boiling above substantially 300° C.; and recycling at least a portion of said donor fraction to said hydrocracking zone to constitute at least a portion of said liquid hydrogen donor material.

All references to percentages herein indicate percentages by mass unless otherwise indicated.

The types of hydrogen donors usable in the process include tetralin and similar materials which transfer hydrogen to acceptor radicals which are created by the thermal cracking of high molecular weight constituents of the feed oil. Useful donor compounds can be obtained by hydrogenating some highly aromatic refinery distillate streams, for example light cycle oil, with a boiling range, for example, between 200° C. and 300° C. A preferred method of obtaining a suitable donor stream is by fractionally distilling the hydrocracked product of the present process to yield a cut from about 200° C. to 300° C., preferably from 220° C. to 290° C., and a recycled stream thus obtained is sufficient to maintain the hydrocracking process without addition of makeup donor material. The process is therefore seen to provide a net creation of donor species. Separate rehydrogenation of donors for recycling to the reaction zone is unnecessary, a sufficient level of hydrogen in the donor species being maintained in the reaction zone, because of the hydrogen partial pressure. The ratio of hydrogen donor material to residuum feedstock can be from 0.5:1 to 4:1, preferably from 1:1 to 2:1.

The catalyst comprises hydrogenation catalysts including cobalt, molybdenum, nickel, tungsten or mixtures thereof, which optionally can be composited with inert supporting material, for example alumina. Preferred catalysts comprise spent hydrodesulphurization catalysts containing cobalt-molybdenum or nickel-tungsten blends. Although a fresh catalyst can be used effectively, it is preferable to use a crushed spent pelletized catalyst because spent catalysts are low in cost. When the spent pelletized catalyst is crushed, not only is its surface-to-volume ratio increased, but also previously unexposed and uncontaminated catalytic surface is made available. When a spent catalyst is used it must be crushed to a finely-divided state in order to expose new catalytically active surface; a useful size range is between 20 and 400 mesh (841 μm and 37 μm), preferably between 40 and 325 mesh (420 μm and 44 μm); the catalyst is optionally presulphided by, for example, reacting it with carbon disulphide under a nitrogen atmosphere at about 1.5 MPa. The concentration of catalyst can be from 0.1% to 10% of the heavy oil feed, preferably 3% to 5%, and the catalyst is introduced as a slurry in the heavy oil feed. The catalyst can be recycled up to at least six times, and after use in the present process it can be regenerated to remove most of the coke which is deposited during operation. The catalyst activity reduces gradually with each recycle and it is operable in the process with up to 40% metals deposited, based on the original catalyst mass. Additional constituents, for example mineral matter in the crude, also dilute the catalyst and to maintain the catalyst concentration, a greater mass of material is added in the recycle runs than in the original run. The solvent effect of the aromatic donor compounds of the invention is a significant contributor to the life of the catalyst and its ability to be recycled several times before being regenerated.

The hydrocarbonaceous oil feedstock can be any heavy crude oil or bitumen having an API gravity numerically less than 25°, or residuum thereof, individually or in combination, for example Lloydminster heavy oil. Athabasca oil sands bitumen is a preferred feedstock, more preferably the residuum from atmospheric or vacuum distillation of said bitumen, boiling above about 300° C. to 570° C. The process can be advantageously used also with residua of conventional crude oils having an API gravity about 25°, i.e. specific gravity less than 0.9042.

In operation of a preferred embodiment, the finely-divided catalyst is mixed with the hydrogen donor and the feedstock and brought into the hydrocracking zone under pressure of a free hydrogen-rich gas from about 1.4 to 17 MPa, preferably from about 11 to 17 MPa. The free hydrogen-rich gas can be molecular hydrogen or gases rich in molecular hydrogen, for example, reformer gas or coke oven gas. The necessary overpressure decreases with increasing hydrogen content of the gas. When pure hydrogen is used, the preferred pressure range is from about 1.4 to 14 MPa. The reaction proceeds in the temperature range from about 400° C. to 450° C., preferably 410° C. to 430° C., and with a residence time of about 0.2 to 10 hours, preferably from about 2 to 3.5 hours.

Upon removal from the reaction zone, the hydrocracked product stream can be fractionally distilled to separate gases, naphthas and other distillates and a residuum stream, boiling, for example, above a temperature from 300° C. to 570° C. It may be desired to recycle certain of these streams, for example the middle distillates which contain a valuable concentration of hydrogen donor compounds. The mass of donor compounds in the hydrocracked stream exceeds the original amount of donor materials added to the reaction, that is, a net manufacture of donors occurs. Thus it is possible to operate continuously with recycled material comprising the entire feed of hydrogen donor to the reaction and no external make-up of hydrogen donor material. The residuum product stream can also, if desired, be recycled several times, with a small purge to prevent a build-up of inorganic materials in the residuum.

The invention will now be more particularly described with reference to the following examples, which represent preferred embodiments thereof.

EXAMPLES 1-4

Samples of two spent desulphurizing catalysts were crushed and screened into the size range 40 to 325 mesh.

The catalyst characteristics are shown in Table 1.

TABLE 1

| | Catalyst Characteristics | |
|---|---|---|
| | Co—Mo | Ni—W |
| Carbon | 0.20% | 0.1% |
| Sulphur | 0.77% | 0.43% |
| Cobalt | 2.82% | — |
| Molybdenum | 10.86% | 0.2% |
| Nickel | 0.79% | 3.95% |
| Vanadium | 0.02% | — |
| Tungsten | — | 17.8% |
| Surface Area | 146.0 $m^2/g$ | 232 $m^2/g$ |
| Pore Volume | 0.40 mL/g | 0.45 mL/g |

TABLE 1-continued

| | Catalyst Characteristics | |
|---|---|---|
| | Co—Mo | Ni—W |
| Weight Loss (110° C.) | 0.14% | 0.02% |
| Ash (593° C.) | 96.8% | 97.8% |

The catalysts were presulphided by mixing with carbon disulphide in the ratio 0.75 kg sulphur (in $CS_2$) per 10 kg catalyst under nitrogen pressure of 1.5 MPa at 235° C. for 6 hours. The hydrogen donor diluent was the 221°-293° C. fraction of a hydrogenated light cycle oil, containing 71.5% monoaromatic compounds, including 53.2% of $z=-8$ materials and 13.5% diaromatic compounds including 9.7% of $z=-12$ materials. In a typical experimental run, a quantity of 205 g of hydrogen donor diluent was mixed in a one-liter autoclave with an equal quantity of vacuum residuum of Athabasca oil sands bitumen boiling over 504° C. (Athabasca VTB), and catalyst added as listed in Table 3. With a hydrogen overpressure of 2.3 MPa the closed autoclave was heated to 415° C. with stirring; further hydrogen was then added to bring the pressure up to about 10.3 MPa. Hydrogen was added during the two-hour experimental runs to maintain a pressure between 10.0 and 10.7 MPa, and an average pressure of 10.3 MPa throughout the run. A total cumulative pressure drop of 3.4 MPa was observed. After cooling at the end of the run the gases were metered and two 125 ml samples collected. The liquid products were separated from the catalyst and distilled into naphtha, middle distillate and gas oil fractions leaving a residuum boiling above 504° C. The compositions of all products and the catalyst were analyzed.

TABLE 2

| | UPGRADING ATHABASCA BITUMEN | | | | |
|---|---|---|---|---|---|
| | Ex. 1 | Ex. 2 | Ex. 3 | Ex. 4 | No Catalyst |
| Catalyst Type | Co—Mo | Co—Mo | Co—Mo | Ni—W | None |
| Catalyst Concentration, % of Resid. | 2.5% | 5.0% | 10.0% | 2.5% | — |
| Pressure, MPa | 10.3 | 10.3 | 10.3 | 10.3 | 13.8 |
| Product Distribution, % | | | | | |
| Gases (−C3) | 9.4 | 10.3 | 10.1 | 10.1 | 10.9 |
| Naphtha (C4-200° C.) | 11.5 | 15.2 | 17.3 | 15.9 | 19.1 |
| Middle Distillate (200-360° C.) | 18.1 | 15.6 | 17.8 | 16.6 | 19.0 |
| Gas Oil (360-504° C.) | 16.6 | 19.0 | 18.1 | 11.8 | 12.1 |
| Residuum (504° C.+) | 43.7 | 38.7 | 34.8 | 45.0 | 37.8 |
| Coke | 0.7 | 1.1 | 1.8 | 0.6 | 1.1 |
| Conversion of residuum feed to distillables | 55.6% | 60.1% | 63.3% | 54.4% | 61.1% |
| Desulphurization | 62.0% | 76.2% | 86.7% | 58.0% | 20.1% |
| Ni demetallization | 65.7% | 88.8% | 92.8% | 62.2% | 22.5% |
| V demetallization | 88.0% | 97.0% | 97.7% | 74.0% | 18.3% |
| Decrease in asphaltenes | 65.6% | 78.8% | 83.6% | 62.4% | 53.2% |
| Increase in mass of donor compounds | 6.2% | 11.3% | 11.1% | 9.8% | 6.0% |

As shown in Table 2, high levels of desulphurization and demetallization were achieved and a high percentage of feed residuum was converted to products boiling below 504° C. Compared to a similar run conducted without catalyst, the products were more saturated and of lower metal and sulphur content, including the residuum which was also much softer than the brittle product of the non-catalyzed reaction, despite the lower pressure in the catalyst run. In the non-catalyzed run, the initial hot pressure of 10.3 MPa increased during the run because of lower hydrogen uptake and increased gas production compared to the catalyzed run. The increase in the mass of donor compounds was more than sufficient to maintain the process with the sole supply of donor material being the produced donor compounds. Carbon laydown on the catalyst is the limiting factor in catalyst activity, but it is clear that many batch runs can be done before it becomes necessary to regenerate the catalyst.

For comparison, the results of a similar run done in the absence of catalyst are also described in Tables 2 and 3. It is seen that although the yield of light products is lower using the catalyst, the demetallization and desulphurization are markedly better than in the non-catalyzed reaction. The saturation level of the catalyzed products is also higher, and this factor is correlated with the hydrogen uptake as measured by the total cumulative pressure drop, which was 3.3 MPa in Example 2 versus only 1.0 MPa in the non-catalyzed run, prior to the increase caused by the subsequent production of gases in the non-catalyzed run.

TABLE 3

PRODUCT COMPOSITION AND CHARACTERISTICS

| | Ex. 1 | Ex. 2 | Ex. 3 | Ex. 4 | No Catalyst |
|---|---|---|---|---|---|
| Catalyst | Co—Mo | Co—Mo | Co—Mo | Ni—W | None |
| Concentration on V.T.B. | 2.5% | 5.0% | 10.0% | 2.5% | — |
| Naphtha | | | | | |
| Paraffins | 56.1% | 55.3% | 56.6% | 56.3% | 53.0% |
| Cycloparaffins | 27.5% | 27.1% | 27.7% | 24.3% | 20.4% |
| Olefins | 7.5% | 4.0% | 2.2% | 10.3% | 18.8% |
| Aromatics | 8.8% | 13.7% | 13.4% | 8.8% | 8.1% |
| Specific Gravity | 0.767 | 0.790 | 0.769 | 0.755 | 0.754 |
| Distillate | | | | | |
| Paraffins | 11.5% | 9.7% | 11.6% | 8.8% | 12.1% |
| Cycloparaffins | 9.9% | 8.2% | 9.4% | 9.4% | 11.9% |
| Monoaromatics z-6 | 11.4% | 10.2% | 10.5% | 11.1% | 10.2% |
| Monoaromatics z-8 | 38.6% | 36.4% | 30.3% | 39.3% | 31.6% |
| Monoaromatics z-10 | 4.4% | 4.4% | 3.1% | 4.5% | 3.6% |
| Diaromatics z-12 | 18.1% | 24.0% | 29.1% | 19.9% | 23.1% |
| Diaromatics z-14 | 4.8% | 5.4% | 4.3% | 5.4% | 5.4% |
| Diaromatics z-16 | 0.8% | 1.1% | 1.0% | 1.0% | 1.0% |
| Triaromatics | 0.4% | 0.5% | 0.7% | 0.6% | 0.6% |
| Aromatic Sulphur cpds. | 0.0% | 0.1% | 0.1% | 0.1% | 0.6% |
| Gas Oil | | | | | |
| Paraffins | 8.1% | 10.8% | 11.2% | 7.0% | 5.1% |
| Cycloparaffins | 28.3% | 29.2% | 31.4% | 26.8% | 22.1% |
| Monoaromatics | 13.0% | 15.4% | 14.4% | 12.5% | 10.8% |
| Diaromatics | 11.6% | 12.2% | 12.0% | 10.4% | 11.1% |
| Other Aromatics | 24.9% | 22.2% | 22.7% | 27.3% | 31.0% |
| Aromatic sulphur cpds. | 13.7% | 9.7% | 8.0% | 15.8% | 19.1% |
| Specific Gravity | 0.973 | 0.960 | 0.959 | 0.979 | 0.999 |
| Residuum | | | | | |
| Penetration (25° C.), $10^{-4}$ m | 25 | 91 | 255 | 23 | 0 |
| Softening Point | 50° C. | 38° C. | 37° C. | 52° C. | 76° C. |

EXAMPLE 5

To demonstrate the effect of donor recycling, a hydrogen donor diluent was prepared from the distillate product of an experimental run similar to Example 2, by separating the 200°–291° C. fraction from the remainder of the distillate (291°–360° C.). A sample of the fraction was mixed with an equal quantity of Athabasca vacuum residuum and cobalt-molybdenum catalyst described in Table 1 was added in the amount of 5% based on the residuum. With a hydrogen overpressure of 2.3 MPa the closed one-liter autoclave was heated to 415° C. with stirring, and hydrogen was then added to bring the pressure up to 10.3 MPa. During the two-hour heating period, hydrogen was periodically added to maintain the pressure above 10.0 MPa, averaging 10.3 MPa. The cooled autoclave was discharged and products measured as in the previous examples. The distillate fraction was further cut into a 200°–291° C. fraction and a 291°–360° C. fraction, and the lower-boiling fraction was used in the subsequent cycle as the donor diluent. Tables 4 and 5 describe the products and product quality.

TABLE 4

DONOR RECYCLING

| | Recycle 1 | Recycle 2 | Recycle 3 |
|---|---|---|---|
| Athabasca VTB feed/donor diluent ratio | 1:1 | 1:1 | 1:1 |
| Product Distribution, % | | | |
| Gases (to C3) | 9.7 | 10.1 | 11.7 |
| Naphtha (C4-200° C.) | 21.6 | 24.2 | 25.8 |
| Distillate | 14.4 | 9.3 | 11.4 |
| Gas Oil | 19.4 | 21.6 | 17.0 |
| Residuum | 33.5 | 33.7 | 32.9 |
| Coke | 1.4 | 1.2 | 1.2 |
| Conversion of Resid. to Distillables, % | 65.1 | 65.2 | 65.9 |
| Desulphurization, % | 71.3 | 52.0 | 84.7 |
| Ni demetallization, % | 83.1 | 84.8 | 90.4 |
| V demetallization, % | 86.0 | 89.4 | 93.2 |
| Decrease in asphaltenes | 67.8 | 71.9 | 76.3 |
| Increase in mass of donor compounds | 7.4 | 1.6 | 7.4 |

The mass of donor compounds showed a net increase in the series of runs, and the hydrogenation level was maintained, indicating that sufficient hydrogen donor is produced to operate using only a recycled donor material and no donor make-up after the initial cycle. That the process remains effective with recycled material providing the only source of donor is apparent from the uniform conversion, desulphurization, demetallization and product quality throughout the sequence of recycle runs.

TABLE 5

| PRODUCT COMPOSITION AND CHARACTERISTICS | Recycle 1 | Recycle 2 | Recycle 3 |
|---|---|---|---|
| Naphtha, Volume Percent | | | |
| Paraffins | 57.4% | 57.7% | 57.7% |
| Cycloparaffins | 28.2% | 28.5% | 27.9% |
| Olefins | 4.7% | 4.0% | 4.9% |
| Aromatics | 9.8% | 9.9% | 9.5% |
| Specific Gravity | 0.772 | 0.785 | 0.794 |
| Distillate, Weight Percent | | | |
| Paraffins | 17.4% | 17.9% | 16.3% |
| Cycloparaffins | 16.8 | 17.1 | 16.1 |
| Monoaromatics z-6 | 7.5 | 7.6 | 9.1 |
| Monoaromatics z-8 | 23.6 | 24.0 | 24.6 |
| Monoaromatics z-10 | 3.6 | 3.6 | 4.3 |
| Diaromatics z-12 | 23.4 | 22.8 | 22.7 |
| Diaromatics z-14 | 4.2 | 3.7 | 4.1 |
| Diaromatics z-16 | 1.1 | 1.0 | 1.2 |
| Triaromatics | 0.6% | 0.7% | 0.6% |
| Aromatic Sulphur cpds. | 1.6% | 1.8% | 2.1% |
| Gas Oil | | | |
| Paraffins | 7.6% | 7.7% | 6.7% |
| Cycloparaffins | 24.9% | 23.1% | 23.8% |
| Monoaromatics | 12.2% | 12.7% | 12.4% |
| Diaromatics | 11.8% | 13.3% | 11.4% |
| Other Aromatics | 30.9% | 32.6% | 34.1% |
| Aromatic Sulphur cpds. | 12.2% | 10.2% | 11.1% |
| Specific Gravity | 0.975 | 0.971 | 0.977 |
| Residuum | | | |
| Penetration (25° C.), $10^{-4}$ m | 16 | 19 | 21 |
| Softening Point | 54° C. | 53° C. | 53° C. |

EXAMPLE 6

To illustrate the capacity of the process to upgrade further its own product residuum, a sample of product residuum was prepared by mixing residua produced in Example 2 and all three recycles of Example 5. The hydrogen donor diluent was prepared by separating the 200°–291° C. stream from the remainder of the distillate stream, and equal quantities of donor diluent and residuum were then placed in a 300 ml autoclave together with the cobalt-molybdenum catalyst and treated as in the preceding Examples. The yield and composition of the products are shown in Table 6.

TABLE 6

| EFFECT OF RECYCLED RESIDUUM AS FEED | |
|---|---|
| Catalyst Concentration, % of Resid. Feed | 5.0% |
| Product Distribution, overall (two passes) | |
| Gas | 13.9% |
| Naphtha | 19.4% |
| Distillate | 15.1% |
| Gas Oil | 25.8% |
| Residuum | 24.4% |
| Coke | 1.7% |
| Desulphurization | 90.8% |
| Ni demetallization | 88.8% |
| V demetallization | 99.7% |
| Decrease in Asphaltenes | 82.8% |
| Increase in Donor Compounds Mass | +7.0% |

Using the recycled residuum, a further 36.3% of the material boiling above 504° C. was converted to material boiling below 504° C.; combined with the original conversion of 67.2% on average, the overall conversion of residuum was 79.1% on a two-pass basis. Further recycling of product residuum achieves a further increase in total conversion, and the product residuum becomes more refractory with each successive pass. The limiting factor in recycling of the residuum is primarily its ash content which must be purged to prevent an indefinite build-up, and secondarily the refractory nature of some of its constituents and their inability to be cracked at the process conditions of the invention. Nickel demetallization in the second stage of Example 6 was small, but total desulphurization and vanadium demetallization were significantly greater than in a single pass. There was a net gain in the mass of donor compounds available for recycling and re-use in the reaction zone.

The process of the invention is thus shown to be operable with spent catalyst of the major used in desulphurization processes in the refining industry. An advantage of the present invention is that it yields products which are more saturated compared to products of an uncatalyzed lower-pressure donor process carried out in the absence of free hydrogen, and it provides high demetallization and desulphurization. A further advantage is that the mass of donor materials increases, permitting recycled donor material to supply the entire ongoing need for donor. In addition, there is no need to rehydrogenate the recycled donor materials because they have sufficient hydrogen saturation in the reactor effluent to be used directly in a recycle after fractional distillation.

The process is applicable to upgrading heavy oils and bitumens and their residua to enable a greater production of higher-value light products, such as gasoline and diesel fuel. It is useful also in the conversion of low-value residua from conventional and heavy crudes into materials suitable as feedstocks to a catalytic cracking unit.

What is claimed is:

1. A process for upgrading heavy, viscous hydrocarbonaceous oil comprising contacting said oil with a liquid hydrogen donor material, a hydrogen-rich gas and a particulate hydrogenation catalyst in slurry form in a hydrocracking zone at hydrocracking conditions, said hydrocracking conditions including a temperature not lower than substantially 400° C. and not higher than substantially 450° C., to produce a hydrocracked material, said catalyst comprising one of cobalt, molybdenum, nickel, tungsten and mixtures thereof.

2. A process as claimed in claim 1 wherein said catalyst comprises cobalt and molybdenum.

3. A process as claimed in claim 1 wherein said catalyst comprises nickel and tungsten.

4. A process as claimed in claim 1 wherein the concentration of said catalyst is from substantially 0.1% to substantially 10% of said hydrocarbonaceous oil.

5. A process as claimed in claim 4 wherein the concentration of said catalyst is from substantially 3% to substantially 5% of said hydrocarbonaceous oil.

6. A process as claimed in claim 1 wherein said oil comprises oil sands bitumen.

7. A process as claimed in claim 1 wherein said oil comprises a residuum of a heavy crude oil or oil sands bitumen.

8. A process as claimed in claim 1 wherein said oil comprises a residuum of a conventional crude oil.

9. A process as claimed in claim 7 wherein said residuum has a minimum boiling point between substantially 300° C. and substantially 570° C.

10. A process as claimed in claim 1 wherein said conditions include pressure from 1.4 to 17 MPa.

11. A process as claimed in claim 10 wherein said pressure is from substantially 11 to substantially 17 MPa.

12. A process as claimed in claim 1 wherein said hydrogen-rich gas consists essentially of molecular hydrogen.

13. A process as claimed in claim 12 wherein said conditions include pressure from substantially 1.4 to substantially 14 MPa.

14. A process as claimed in claim 1 wherein said temperature is from substantially 410° C. to substantially 430° C.

15. A process as claimed in claim 1 wherein said conditions include residence time from substantially 0.2 to substantially 10 hours.

16. A process as claimed in claim 15 wherein said residence time is from substantially 2 to substantially 3.5 hours.

17. A process is claimed in claim 1 wherein said hydrogen donor material comprises tetralin.

18. A process as claimed in claim 1 wherein said hydrogen donor material comprises a hydrogenated light cycle oil boiling between substantially 200° C. and substantially 300° C.

19. A process as claimed in claim 1 comprising the further steps of separating said hydrocracked material into at least one fraction boiling below substantially 200° C., a donor fraction boiling from substantially 200° C. to substantially 300° C., and at least one fraction boiling above substantially 300° C., and recycling at least a portion of said donor fraction to said hydrocracking zone to constitute at least a portion of said liquid hydrogen donor material.

20. A process as claimed in claim 19 wherein said donor fraction has a boiling range from substantially 220° C. to substantially 290° C.

21. A process as claimed in claim 19 or claim 20 wherein at least a portion of said donor fraction is recycled to said hydrocracking zone to comprise the entire amount of said liquid hydrogen donor material.

22. A process as claimed in claim 1 comprising the additional step of separating said hydrocracked material into at least one distilled hydrocracked fraction having a final boiling point between substantially 300° C. and substantially 570° C. and a hydrocracked residuum.

23. A process as claimed in claim 22 wherein at least a portion of said hydrocracked residuum is recycled to comprise a portion of said heavy, viscous hydrocarbonaceous oil.

24. A process as claimed in claim 1 wherein said particulate hydrogenation catalyst has a particle size from substantially 37 μm to substantially 841 μm.

25. A process as claimed in claim 1 wherein said particulate hydrogenation catalyst has a particle size from substantially 44 μm to substantially 420 μm.

26. A process as claimed in claim 1, wherein said particulate hydrogenation catalyst is a spent pelletized hydrodesulphurization catalyst that has been crushed to a finely-divided state.

27. A process for upgrading heavy, viscous hydrocarbonaceous oil containing non-distillable material boiling above 504° C., comprising:

(a) contacting said oil with a liquid hydrogen donor material, a hydrogen-rich gas and a particulate hydrogenation catalyst in slurry form in a hydrocracking zone at hydrocracking conditions, said hydrocracking conditions including a temperature not lower than substantially 400° C. and not higher than substantially 450° C., and (b) recovering a hydrocracked material containing distillables representing at least substantially 54.4% conversion of said non-distillable material to material boiling below 504° C., said catalyst comprising one of cobalt, molybdenum, nickel, tungsten and mixtures thereof.

* * * * *